US007570276B2

(12) United States Patent
Lee

(10) Patent No.: US 7,570,276 B2
(45) Date of Patent: Aug. 4, 2009

(54) DISPLAY DRIVER CIRCUIT AND DRIVE METHOD THEREOF

(75) Inventor: Yong-Sup Lee, Chungcheongbuk-do (KR)

(73) Assignee: MagnaChip Semiconductor, Ltd., Chungcheonbuk-Do (KR)

( * ) Notice: Subject to any disclaimer, the term of this patent is extended or adjusted under 35 U.S.C. 154(b) by 729 days.

(21) Appl. No.: 11/071,605

(22) Filed: Mar. 2, 2005

(65) Prior Publication Data

US 2005/0237344 A1 Oct. 27, 2005

(51) Int. Cl.
*G09G 5/10* (2006.01)

(52) U.S. Cl. ..... 345/690; 345/100

(58) Field of Classification Search ..... 345/690, 345/204, 87, 89, 98–100; 370/213
See application file for complete search history.

(56) References Cited

U.S. PATENT DOCUMENTS 5,175,549 A * 12/1992 Back ..... 341/152
6,377,234 B1 * 4/2002 Nogawa ..... 345/89
6,724,378 B2 * 4/2004 Tamura et al. ..... 345/204

FOREIGN PATENT DOCUMENTS

JP 08095530 A * 4/1996
JP 08186995 A * 7/1996

* cited by examiner

*Primary Examiner*—Amr Awad
*Assistant Examiner*—Stephen G Sherman
(74) *Attorney, Agent, or Firm*—Blakely, Sokoloff, Taylor & Zafman LLP

(57) ABSTRACT

There is provided a technology that can reduce the number of signal lines by encoding a PWM signal used in a display driver IC. The display driver circuit for displaying a gradation on a display screen based on a PWM signal includes a PWM signal generator for generating a PWM signal, a PWM encoder for encoding the PWM signal generated from the PWM signal generator, a PWM decoder for decoding the encoded PWM signal into the PWM signal, a switching unit for selectively outputting the PWM signal generated from the PWM decoder, a data storage unit for storing a display data used to switch the switching unit, and an SRAM decoder for outputting an on/off signal to the switching unit according to the display data outputted from the data storage unit.

12 Claims, 12 Drawing Sheets

DISPLAY DRIVER CIRCUIT AND DRIVE METHOD THEREOF

FIELD OF THE INVENTION

The present invention relates to a driver circuit for driving a display screen in a liquid crystal display (LCD) or the like; and, more particularly, to a technology that can reduce the number of signal lines by encoding a pulse width modulation (PWM) signal used to implement a gradation display function in a display driver integrated circuit (IC).

DESCRIPTION OF RELATED ART

In driving a liquid crystal display (LCD) or the like, an active addressing technology is recently used to display an image having a plurality of gradation levels. A representative method is a Frame Rate Control (FRC) method, a Pulse Width Modulation (PWM) method, and an Amplitude Modulation (AM) method.

FIG. 1 illustrates a structure of a circuit used to display a PWM-based gradation in a conventional 256-color LCD driver integrated circuit (IC) having a PWM gradation display function.

Referring to FIG. 1, PWM signals generated from a PWM generator 1 are transmitted to an entire system along 24 ($=3\times8=3\times2^3$) signal lines 2.

In order to represent 256 colors, an SRAM 3 stores 8-bit display data. 3 bits of the 8-bit data represent a red (R) gray scale, and 3 bits represent a green (G) gray scale. The remaining 2 bits and an external 1 bit represent a blue (B) gray scale.

The gray scales of R, G and B colors are determined by the respective 3-bit data and thus eight PWM signals are required. A total of 24 PWM signals are used to represent the entire R, G and B colors.

The SRAM 3 outputs data of X addresses 0 to n at the same time so as to display one line of an LCD panel. The respective 3-bit data turn on one of eight switches through a 3×8 SRAM decoder 4 and one selected PWM signal is outputted.

At this point, the PWM signals are designed to pass through the upper portion of the SRAM within the LCD driver IC and they occupy a wide area. Also, signal interference often occurs between the signal lines. Therefore, if the circuit is badly designed, it may have a bad influence on the operation of the circuit.

Further, in recent years, there is a demand for 4,096 colors or 65K colors in the display. In this case, if the display driver IC is designed using the conventional method, 48 PWM signal lines are required for 4,096 colors and 128 PWM signal lines are required for 65K colors. Accordingly, the signal lines occupy a wide area in the entire IC and it is difficult to scale down the circuit.

SUMMARY OF THE INVENTION

It is, therefore, an object of the present invention to provide a technology that can reduce the number of signal lines by encoding a PWM signal used to implements a gradation display function in a display driver IC, thereby reducing an area occupied by the signal lines and reducing an interference between the signal lines.

In accordance with an aspect of the present invention, there is provided a display driving method for displaying a gradation on a display screen based on a PWM signal. The display driving method includes the steps of: encoding a PWM signal; decoding the encoded PWM signal into the PWM signal; and displaying a gradation on a display screen based on the decoded PWM signal.

In accordance with another aspect of the present invention, there is provided a display driver circuit for displaying a gradation on a display screen based on a PWM signal, the display driver circuit including: a PWM signal generator for generating a PWM signal; a PWM encoder for encoding the PWM signal generated from the PWM signal generator; a PWM decoder for decoding the encoded PWM signal into the PWM signal; a switching means for selectively outputting the PWM signal generated from the PWM decoder; a data storage means for storing a display data used to switch the switching means; and an SRAM decoder for outputting an on/off signal to the switching means according to the display data outputted from the data storage means.

In accordance with a further another aspect of the present invention, there is provided a display driver circuit for displaying a gradation on a display screen on a PWM signal, the display driver circuit including: a PWM signal generator for generating an encoded PWM signal; a PWM decoder for decoding the encoded PWM signal into the PWM signal; a switching means for selectively outputting the PWM signal generated from the PWM decoder; a data storage means for storing a display data used to switch the switching means; and an SRAM decoder for outputting an on/off signal to the switching means according to the display data outputted from the data storage means.

If $2^n$ PWM signals are used, the PWM signal generator generates (n+1) signals by using n signals and a PWM signal having a longest pulse width.

In the case of a 256-color display, the PWM signal generator generates 4 signals, based on 8 PWM signals (PW0, PW1, PW2, PW3, PW4, PW5, PW6 and PW7, whose pulse widths become longer from PW0 to PW7 in this order), the 4 signals being given by a Boolean algebra expression below.

$$E0=\overline{PW0}\cdot PW1+\overline{PW2}\cdot PW3+\overline{PW4}\cdot PW5+\overline{PW6}\cdot PW7$$

$$E1=\overline{PW1}\cdot PW3+\overline{PW5}\cdot PW7$$

$$E2=\overline{PW3}\cdot PW7$$

$$\mathrm{PW7}$$

The PWM decoder generates an intermediate signal by using a Boolean algebra expression below $$D0=PW7\cdot\overline{E2}\cdot\overline{E1}\cdot\overline{E0}$$

$$D1=PW7\cdot\overline{E2}\cdot\overline{E1}\cdot E0$$

$$D2=PW7\cdot\overline{E2}\cdot E1\cdot\overline{E0}$$

$$D3=PW7\cdot\overline{E2}\cdot E1\cdot E0$$

$$D4=PW7\cdot E2\cdot\overline{E1}\cdot\overline{E0}$$

$$D5=PW7\cdot E2\cdot\overline{E1}\cdot E0$$

$$D6=PW7\cdot E2\cdot E1\cdot\overline{E0}$$

$$\mathrm{D7=PW7}$$

and decodes the intermediate signal into a final PWM signal by using a Boolean algebra expression below $$\mathrm{PW0=D0}$$

$$PW1=PW0+D1$$

$$PW2=PW1+D2$$

$PW3=PW2+D3$ $PW4=PW3+D4$ $PW5=PW4+D5$ $PW6=PW5+D6$

PW7=D7

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE INVENTION

Hereinafter, the present invention will be described in detail with reference to the accompanying drawings.

Figure 2:
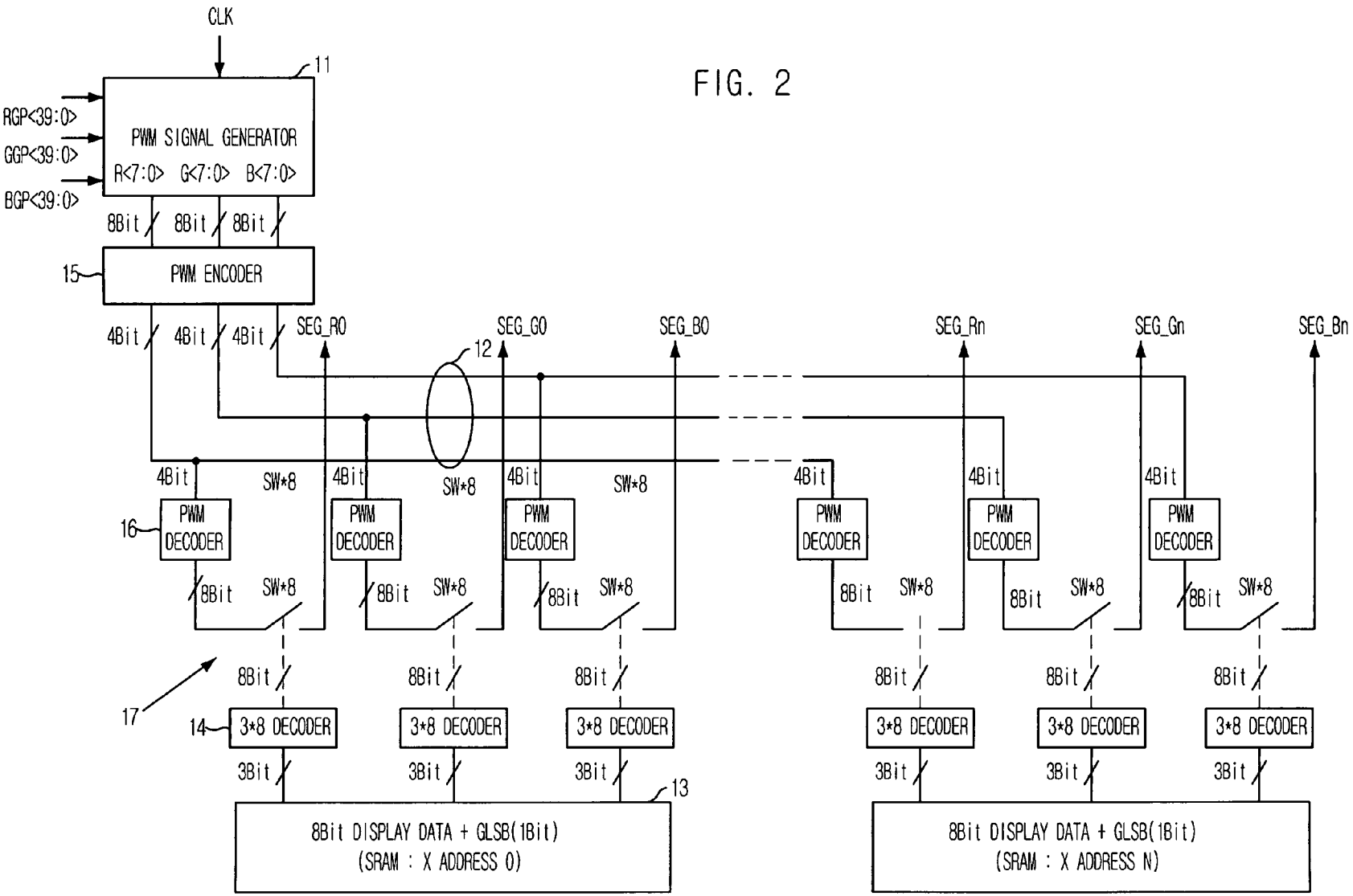
FIG. 2 illustrates a structure of a display driver IC in accordance with a preferred embodiment of the present invention.

FIG. 2 is a circuit diagram of a display driver IC in accordance with a preferred embodiment of the present invention.

Figure 1:
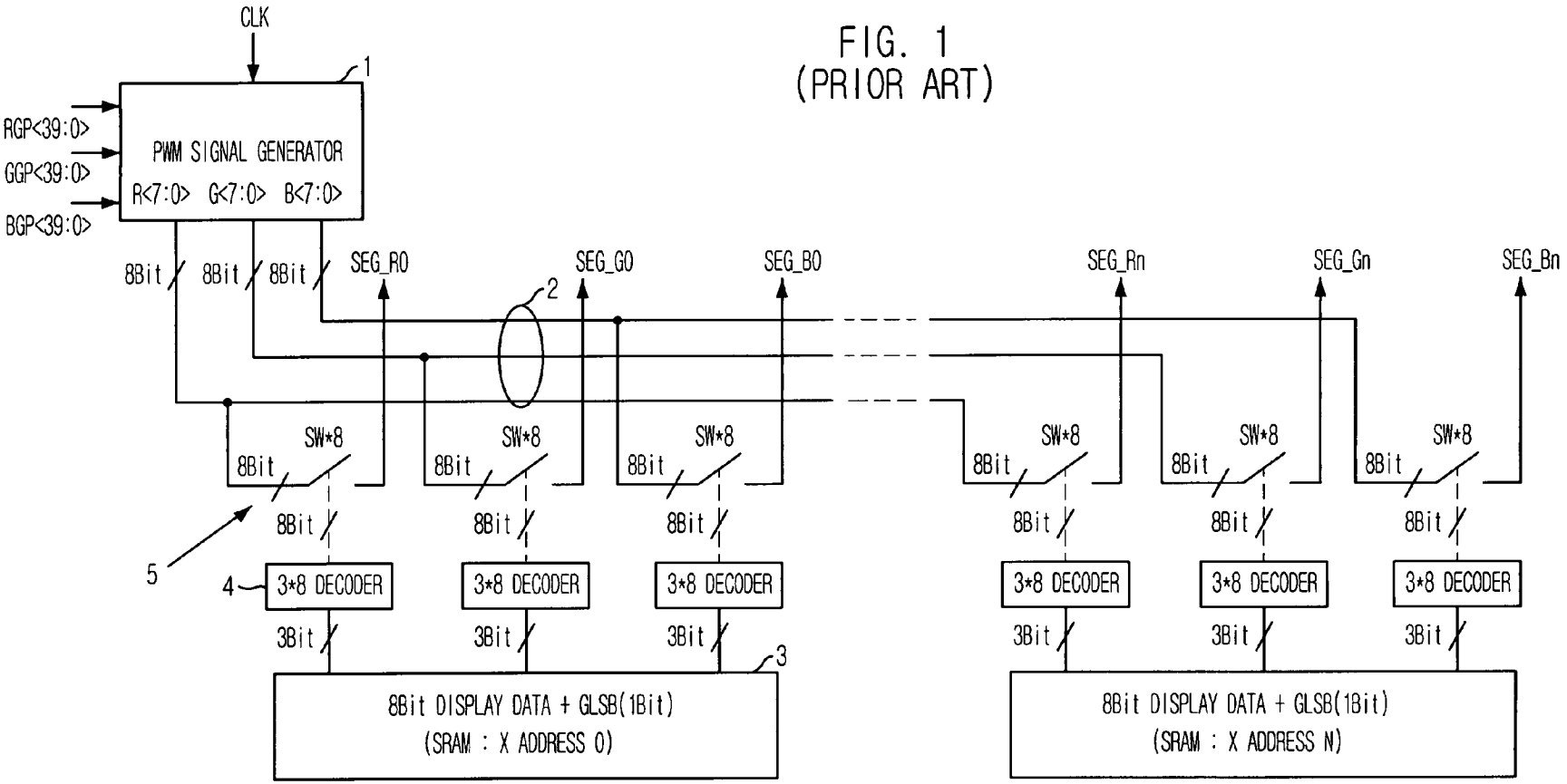
FIG. 1 (PRIOR ART)
FIG. 1 illustrates a structure of a conventional display driver IC having a PWM gradation display function.

A basic structure of the circuit shown in FIG. 2 is similar to that of the conventional circuit shown in FIG. 1. That is, PWM signals are generated from a PWM signal generator 11 so as to represent the gradation and are transmitted to an entire system along PWM signal lines 12. Switches 17 are turned on/off by an SRAM decoder 14, based on display data stored in an SRAM. In this manner, the transmission of the PWM signals is controlled.

However, the display driver IC further includes a PWM encoder 15 and a PWM decoder 16 on a signal path directed from the PWM signal generator 11 and thus the number of the PWM signal lines 12 is reduced.

In FIG. 2, the number of the PWM signal lines is 12 (=3×4). Compared with the 24 (=3×8) signal lines shown in FIG. 1, the number of the PWM signal lines is reduced by half.

Figure 3:
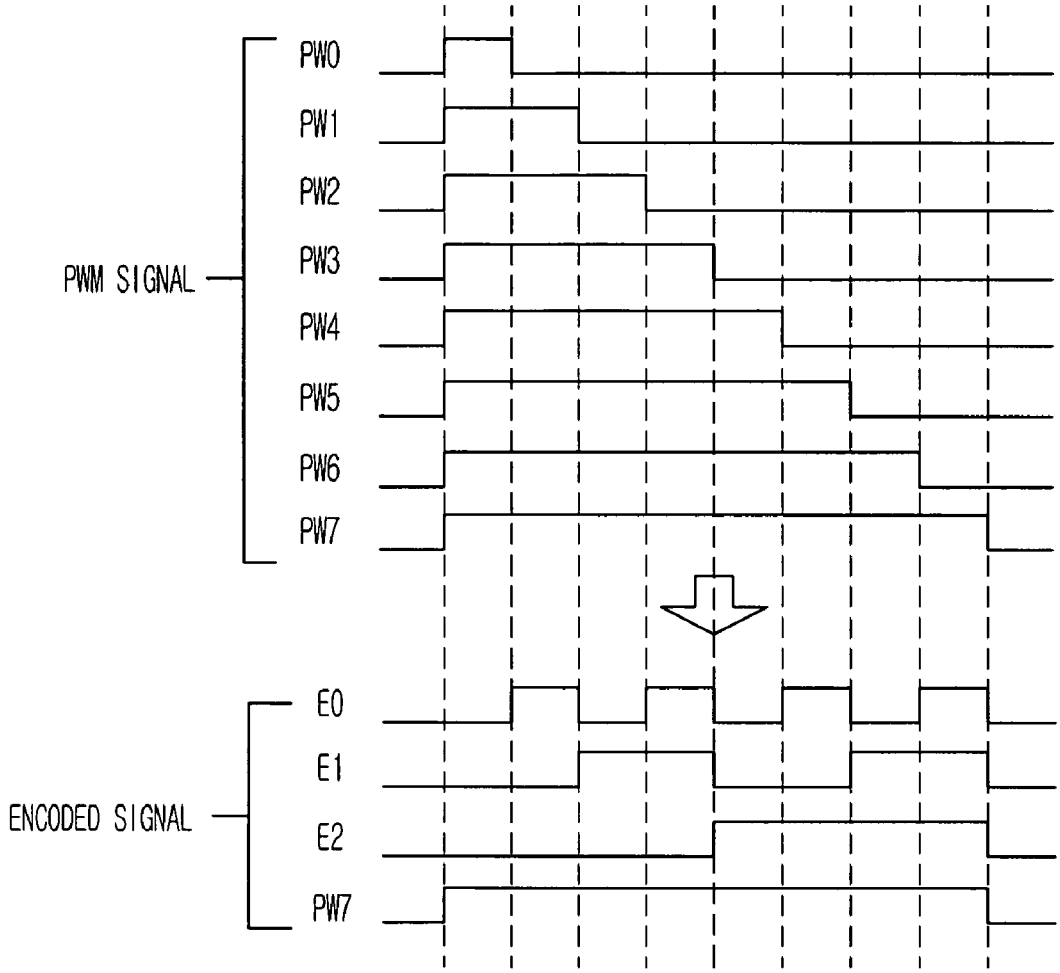
FIG. 3 is a timing chart of an encoded PWM signal generated from a PWM encoder shown in FIG. 2.

The PWM signals generated from the PWM signal generator 11 of FIG. 2 are identical to those of FIG. 1. As shown in FIG. 3, the PWM signals are classified into PW0, PW1, PW2, PW3, PW4, PW5, PW6 and PW7. At this point, it is assumed that the pulse widths of the PWM signals are lengthened from PW0 to PW7 by one unit.

The PWM signals from the PWM signal generator 11 are encoded by a PWM encoder 15 and transmitted to an entire system. The signals transmitted to the respective blocks are decoded later into the original PWM signals by a PWM decoder 16, thereby outputting the desired PWM waveforms.

FIG. 3 is a timing chart illustrating a process of encoding the PWM signals at the PWM encoder 15.

Referring to FIG. 3, the PWM signals are generated as many as $2^n$ signals. Since the $2^n$ signals have a different pulse width, they are divided into $2^n$ if portions where the pulse width is changed are divided by a timing interval.

FIG. 3 illustrates an embodiment when 8 ($=2^3$) PWM signals are used to display 256 colors. In this embodiment, each of R, G and B has 2-bit data and 8 PWM signals corresponding to 3-bit data. Also, if portions where 8 PWM signals are changed are divided based on the pulse width, the signals can be divided into 8 PWM signals having a different pulse width. Here, it is assumed that the PWM signals PW0, PW1, PW2, PW3, PW4, PW5 PW6 and PW7 have the increasing pulse width in this order.

In FIG. 3, in case where the $2^n$ PWM signals (8 PWM signals in FIG. 3) are used, the encoding process using the PWM signals generates (n+1) encoded PWM signals. The (n+1) encoded PWM signals include n encoded PWM signals (3 signals in FIG. 3, i.e., E0 to E2) and one PWM signal (PW7 in FIG. 7). Here, the n encoded PWM signals are processed by a predefined method and the PWM signal PW7 has the longest pulse width and is used to distinguish a portion where there is the signal from a portion where there is no signal.

The encoded PWM signals can be generated based on the PWM signals by a following method.

For example, in case where 8 PWM signals of the 256-color display shown in FIG. 3 are used, the divided 8 PWM signals can be represented by 3 encoded signals and a PWM signal (PW7) having the longest pulse width.

4 output signals of the PWM encoder, which are generated from the 8 PWM signals, are E0 (20), E1 (21), E2 (22) and PW7.

Here, the E0 signal is a signal having 20 digits and a Boolean algebra can be expressed as $$E0=\overline{PW0}\cdot PW1+\overline{PW2}\cdot PW3+\overline{PW4}\cdot PW5+\overline{PW6}\cdot PW7$$

AS can be seen, the encoded signals are generated by combining two adjacent PWM signals.

The E1 signal is a signal having 21 digits and is generated by combining second, fourth, sixth and eighth PWM signals, which can be expressed as $$E1=\overline{PW1}\cdot PW3+\overline{PW5}\cdot PW7$$

The E2 signal is a signal having 22 digits and is generated by combining the fourth and eight PWM signals, which can be expressed as $$E2=\overline{PW3}\cdot PW7$$

Although the PWM signals required for 256 colors are shown in FIG. 3, the PWM signals for 4,096 colors or 65K colors or higher can also be encoded by the above-described method.

For example, the number of the PWM signal lines for 4,096 colors is 15 (5×3 (R, G, B)), and the number of the PWM signal lines for 65K colors is 21 (=7×3 (R, G, B)).

The encoded signals are transmitted to the respective processing blocks and are converted into the original PWM signals (in the case of the 256 colors, 8 PWM signals) by the PWM decoder 16.

Figure 4:
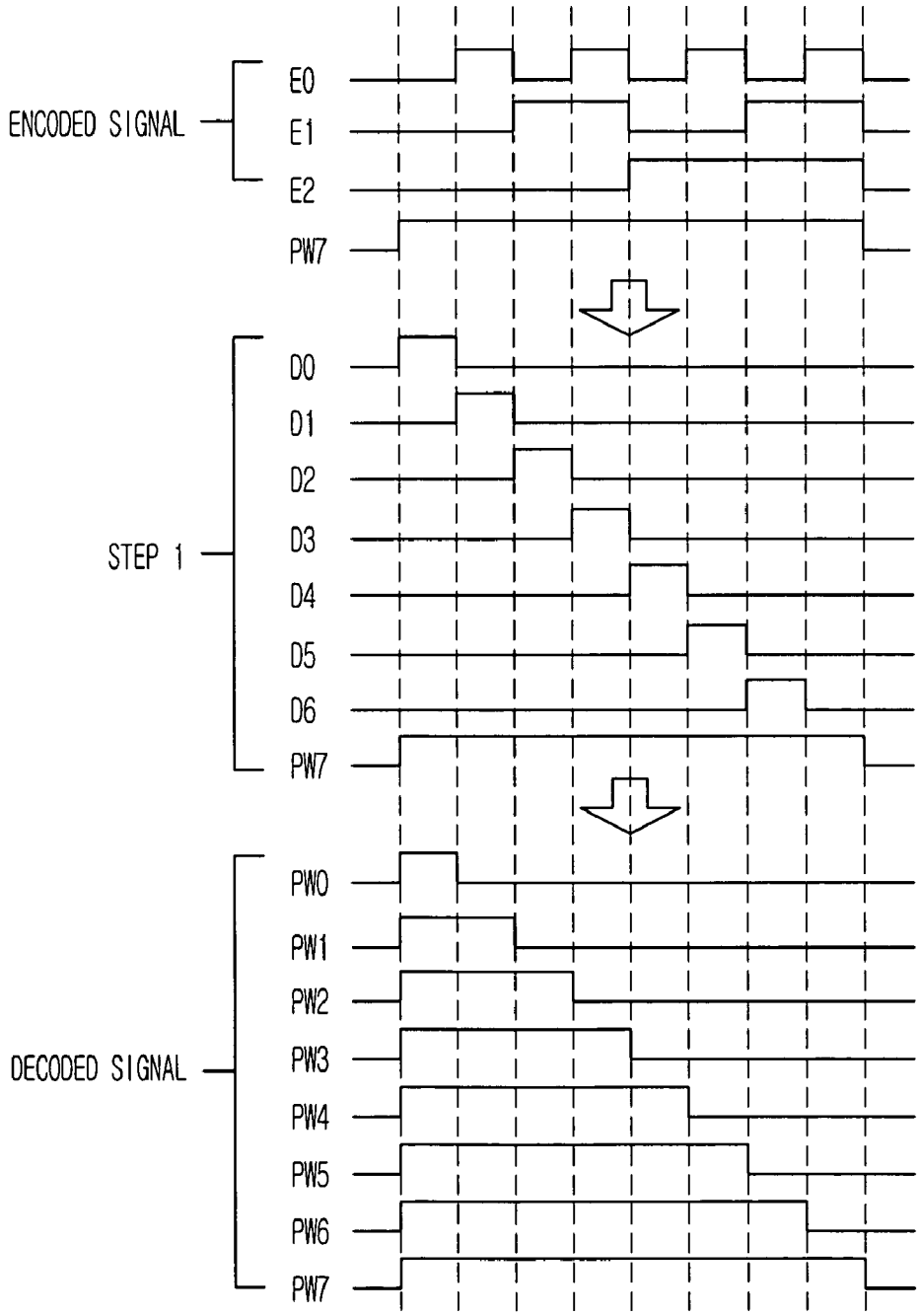
FIG. 4 is a timing chart illustrating a process of decoding the encoded PWM signal at a PWM decoder shown in FIG. 2.

FIG. 4 is a timing diagram illustrating a process of decoding the encoded PWM signals into the original PWM signals.

The decoding process can be carried out by two steps.

The first step is to generate waveforms D0, D1, D2, D3, D4, D5, D6 and D7 shown in FIG. 4.

The waveforms are generated using the following Boolean algebra expression.

$$D0=PW7\cdot\overline{E2}\cdot\overline{E1}\cdot\overline{E0}$$

$$D1=PW7\cdot\overline{E2}\cdot\overline{E1}\cdot E0$$

$$D2=PW7\cdot\overline{E2}\cdot E1\cdot\overline{E0}$$

$$D3=PW7\cdot\overline{E2}\cdot E1\cdot E0$$

$$D4=PW7\cdot E2\cdot\overline{E1}\cdot\overline{E0}$$

$$D5=PW7\cdot E2\cdot\overline{E1}\cdot E0$$

$$D6=PW7\cdot E2\cdot E1\cdot\overline{E0}$$

$$D7=PW7$$

Next, the PWM signals are decoded in the second step of FIG. 2. The finally decoded signals PW0, PW1, PW2, PW3, PW4, PW5, PW6 and PW7 are generated by carrying out an OR logic operation based on the following Boolean algebra expression.

$$PW0=D0$$

$$PW1=PW0+D1$$

$$PW2=PW1+D2$$

$$PW3=PW2+D3$$

$$PW4=PW3+D4$$

$$PW5=PW4+D5$$

$$PW6=PW5+D6$$

$$PW7=D7$$

Meanwhile, the above encoding and decoding methods can be applied to the case where the number of the PWM signals is increased.

The SRAM 13 stores the 8-bit display data so as to represent the 256 colors. 3 bits of the 8-bit data represent a red (R) gray scale, and 3 bits represent a green (G) gray scale. The remaining 2 bits and an external 1 bit represent a blue (B) gray scale.

The SRAM 3 outputs data of X addresses 0 to n at the same time so as to display one line of an LCD panel. The respective 3-bit data turn on one of 8 switches through a 3×8 SRAM decoder 14 and one selected PWM signal is outputted.

Figure 5:
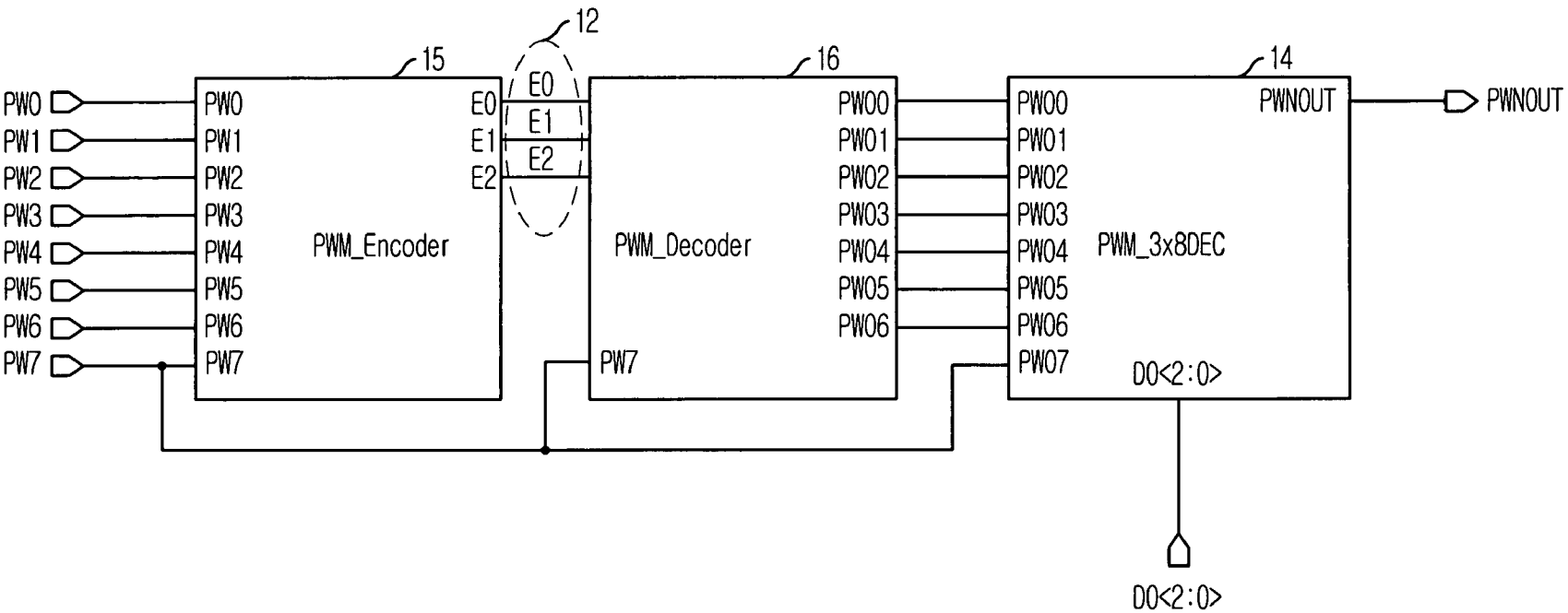
FIG. 5 is a circuit diagram of a PWM decoder, a PWM encoder and an SRAM decoder shown in FIG. 2.

FIG. 5 is a circuit diagram illustrating the connection of the PWM decoder, the PWM encoder, the SRAM decoder and the PWM signal generator (not shown) shown in FIG. 2.

In FIG. 5, the PWM encoder and the PWM decoder are configured with independent ICs. The signal lines between the PWM encoder and the PWM decoder include 4 signal lines. That is, the 4 signal lines include 3 signal lines (E0, E1 and E2) for the encoded PWM signals and the PW7 signal line for the uppermost PWM signal. This display driver IC supports the 256 colors.

However, the present invention is not limited to it.

For example, the PWM decoder 16 can be integrated in a single chip together with the SRAM decoder 14 and can include the switches 17.

In addition, the PWM 15 can be integrated in a single chip together with the PWM signal generator 11. In case of the integrated single chip, the PWM signal generator 11 and the PWM encoder 15 can be integrated physically and functionally. That is, the PWM signal generator 11 can be designed to directly generate the encoded PWM signals E0, E1, E2 and PW7, instead of the PWM signals PW0, PW1, PW2, PW3, PW4, PW5 and PW6.

Figure 6:
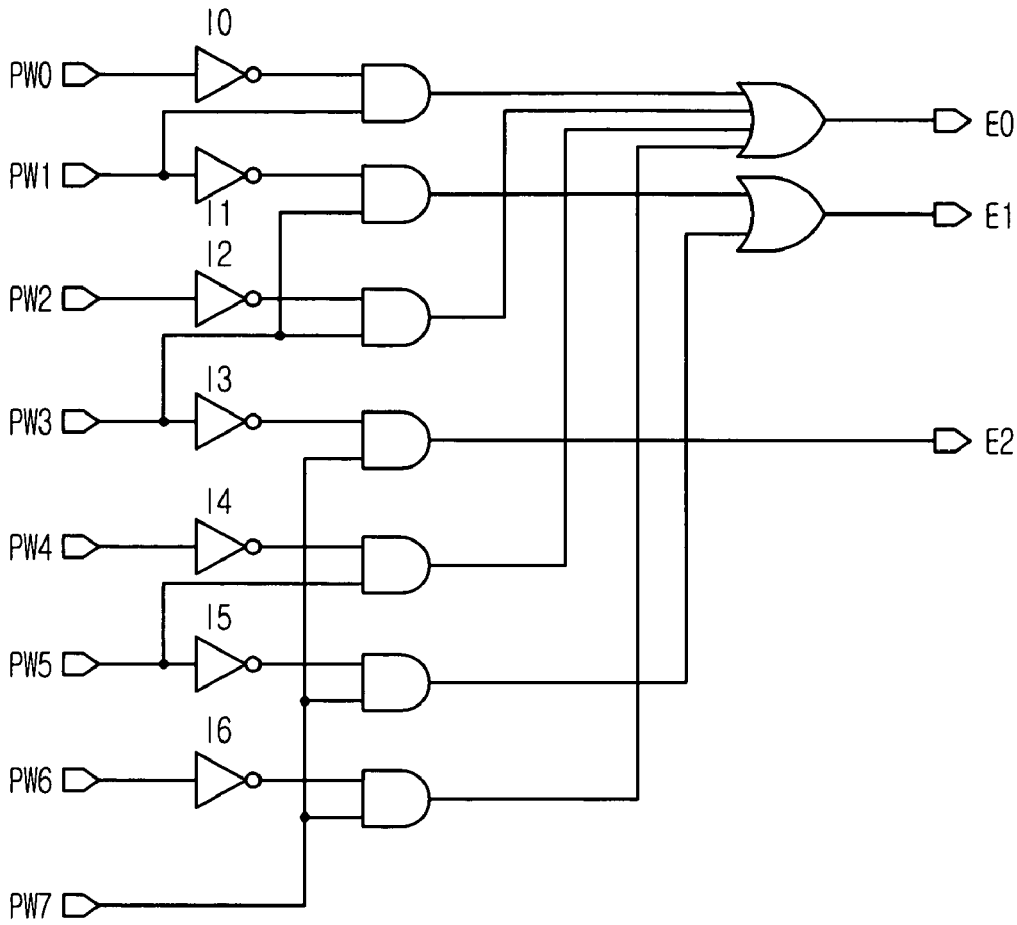
FIG. 6 is a logic circuit diagram of a PWM encoder shown in FIG. 5.

FIG. 6 is a logic circuit diagram of the PWM encoder 15 configured based on the Boolean algebra expression described in the above example. The PWM encoder 15 receives the input signals PW0, PW1, PW2, PW3, PW4, PW5, PW6 and PW7 from the PWM signal generator 11 and outputs the output signals E0, E1 and E2, as shown in FIG. 3.

Figure 7:
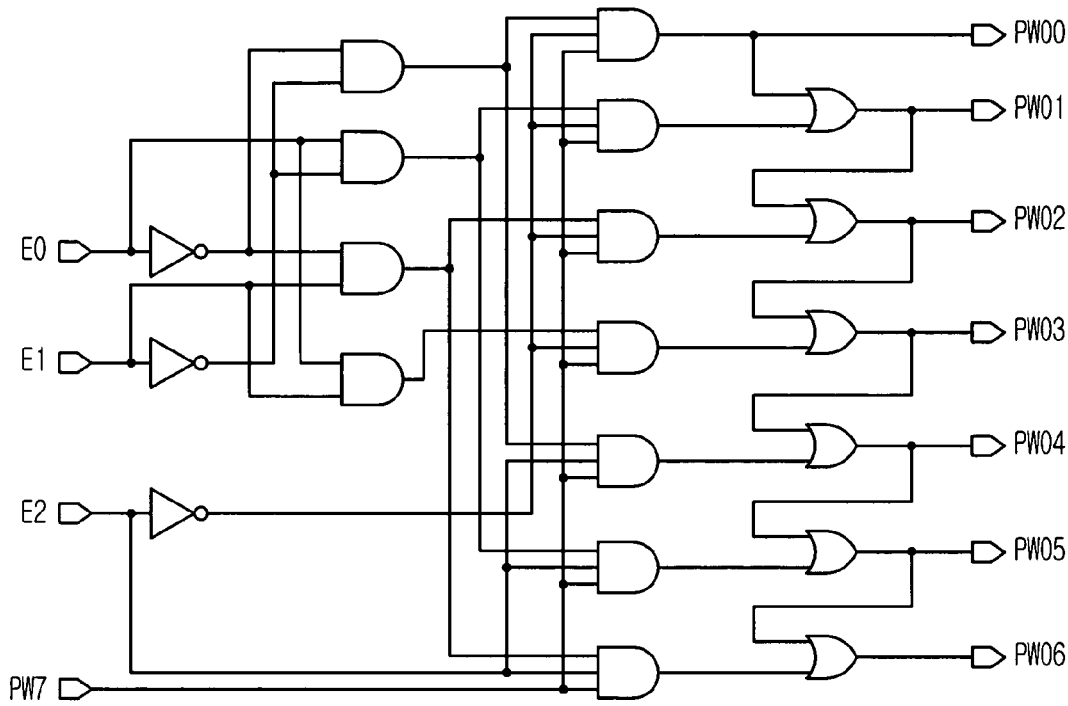
FIG. 7 is a logic circuit diagram of a PWM decoder shown in FIG. 5.

FIG. 7 is a logic circuit diagram of the PWM decoder 16 based on the Boolean algebra expression described in the above example.

The PWM decoder 16 outputs the PWM signals PW0, PW1, PW2, PW3, PW4, PW5, PW6 and PW7 by using the encoded PWM signals E0, E1 and E2 and the longest PWM signal PW7, which are generated from the PWM encoder 15 and transmitted along the signal lines 12.

Figure 8:
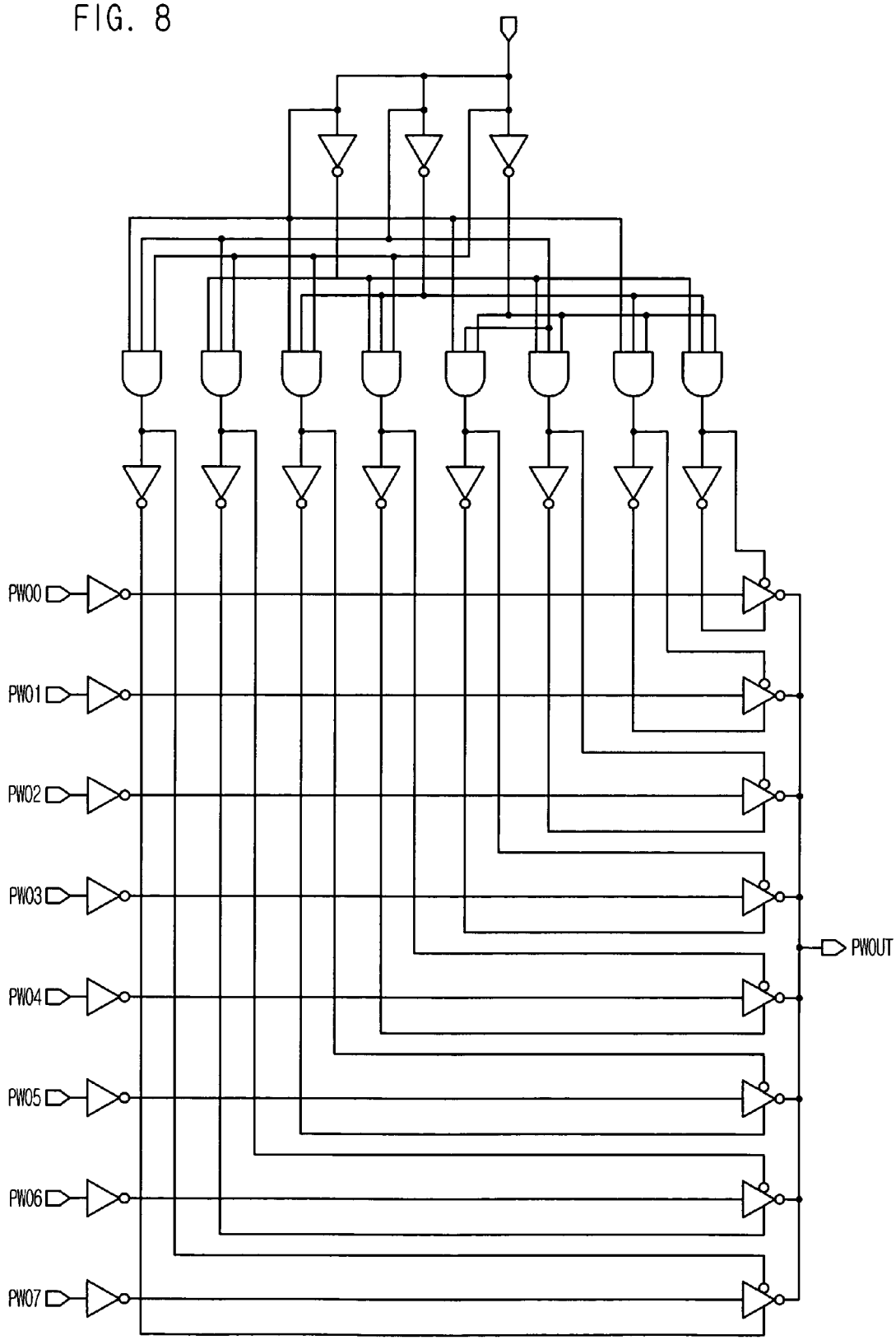
FIG. 8 is a logic circuit diagram of an SRAM encoder and a switching block.

FIG. 8 is a schematic circuit diagram of the 3×8 SRAM decoder 14 and the switch circuit. One of the 8 PWM signals PW0, PW1, PW2, PW3, PW4, PW5, PW6 and PW7 is selected based on the display data DD outputted from the SRAM encoder 14.

Figure 9:
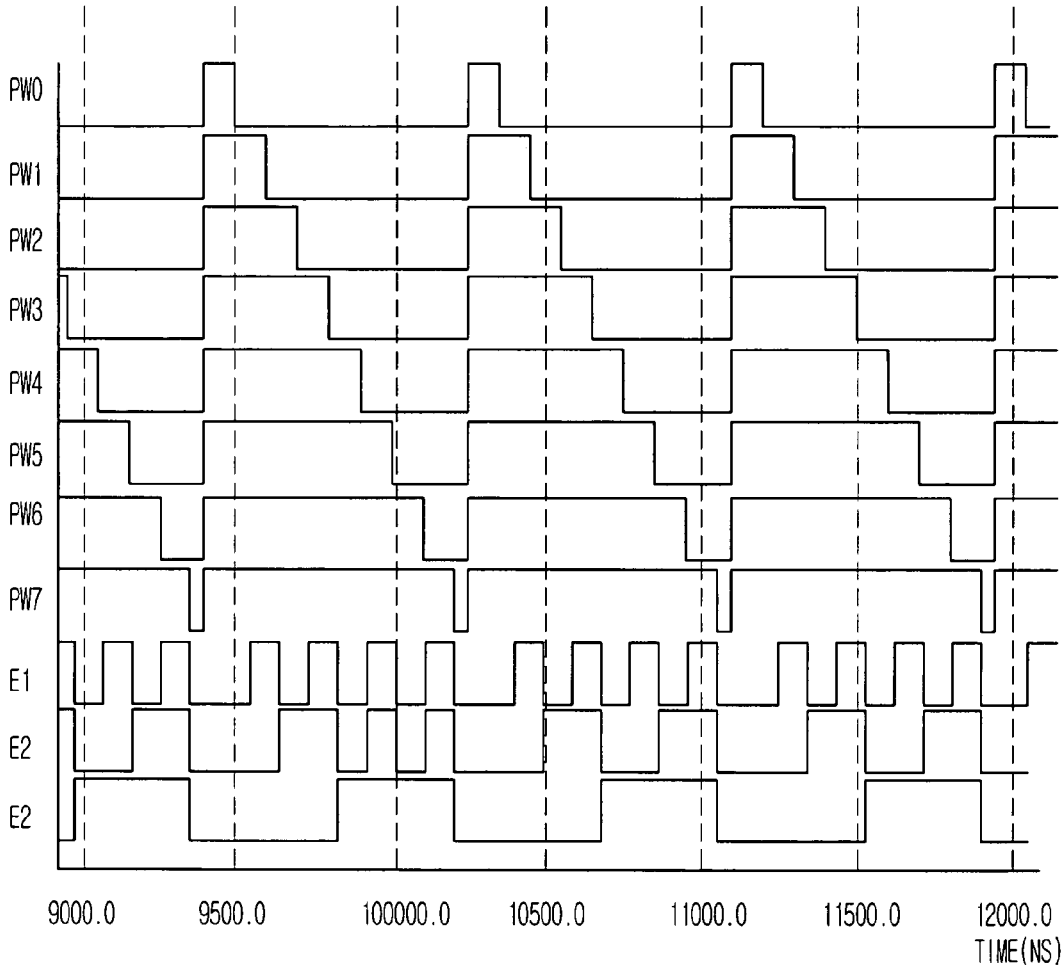
FIGS. 9 to 12 are timing charts of signals shown in FIGS. 5 to 8.

FIG. 9 is a timing diagram of the signals when the PWM signals are encoded by the PWM encoder 15.

Figure 10:
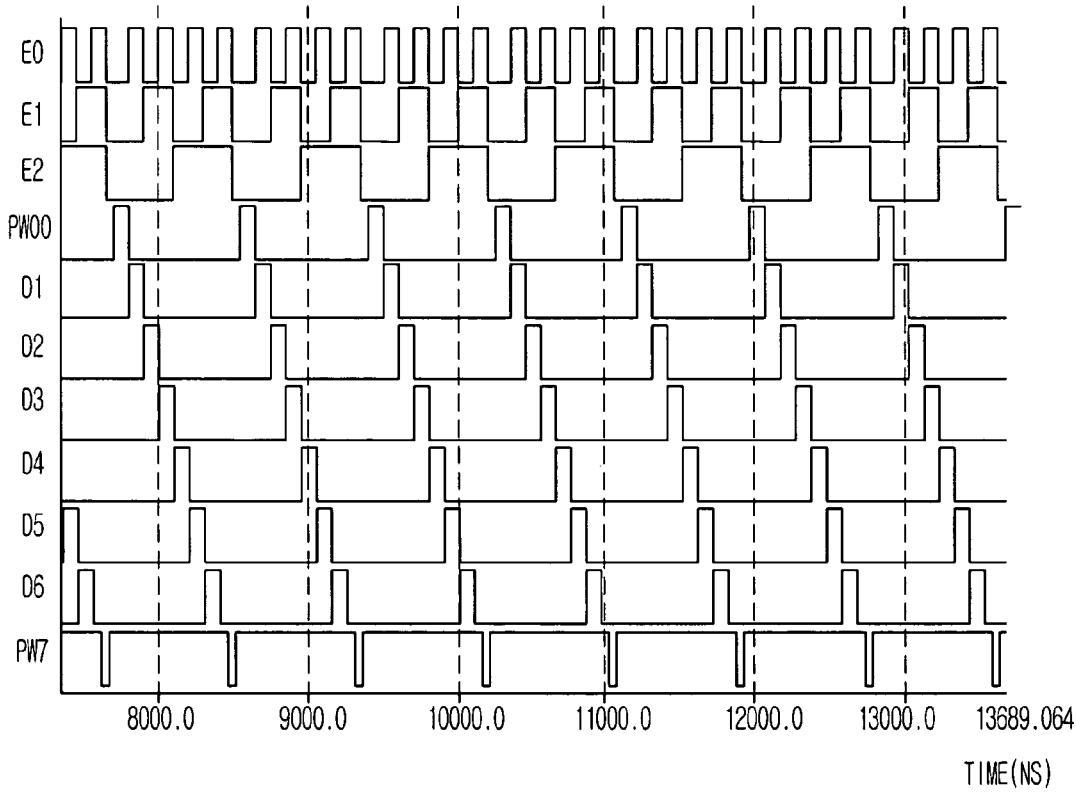
Figure 11:
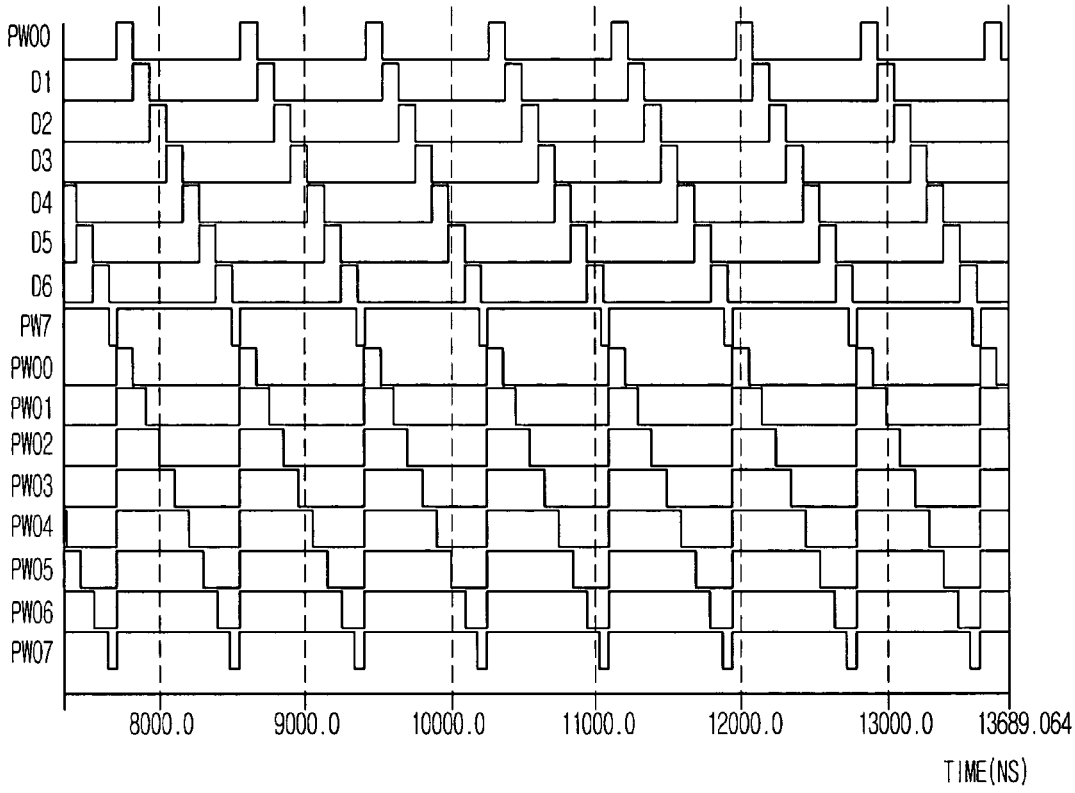

Also, FIG. 10 is a timing diagram of the signals PW0, D1, D2, D3, D4, D5, D6 and D7 in the first step when the encoded signals are decoded by the PWM decoder 16 of FIG. 7. FIG. 11 is a timing diagram of the signals after the PWM signals are decoded using the output signal of the first step.

Figure 12:
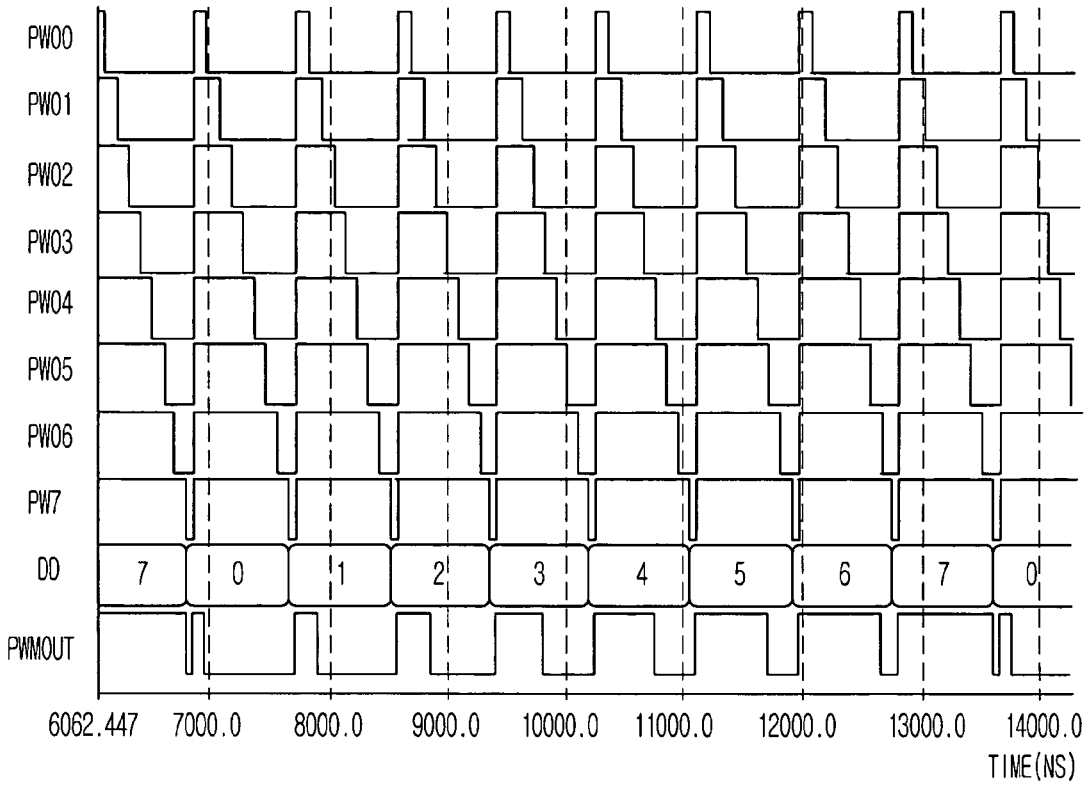

FIG. 12 is a timing diagram illustrating the final waveform of the output stage through which the SRAM signals corresponding to the PWM signals are outputted according to the display data of the SRAM by using the output signals of the second step shown in FIG. 11.

As can be seen from FIGS. 9 to 12, the elements of FIG. 5 correctly carry out their functions.

The present invention can be applied to the case of 4,096 colors or the case of 65K colors, in addition to the case of 256 colors.

The LCD display driver IC having the PWM-based gradation display function is designed to perform the encoding operation on the PWM signal transmission path. Accordingly, it is possible to reduce the number of the PWM signal lines and the entire area of the IC. In addition, the noise between the signal lines can be reduced. Further, it is possible to minimize the increase of the chip size, which is caused by the increase in the number of colors.

The present application contains subject matter related to Korean patent application No. 2004-27515, filed in the Korean Patent Office on Apr. 21, 2004, the entire contents of which being incorporated herein by reference.

While the present invention has been described with respect to the particular embodiments, it will be apparent to those skilled in the art that various changes and modifications may be made without departing from the spirit and scope of the invention as defined in the following claims.

What is claimed is:

1. A display driving method for displaying a gradation on a display screen based on $2^n$ PWM signals, the display driving method comprising:

encoding the $2^n$ PWM signals to generate n encoded PWM signals;

transferring (n+1) signals including the n encoded PWM signals and one PWM signal having a longest pulse width through (n+1) signal lines;

receiving the (n+1) signals and decoding the n encoded PWM signals based on one PWM signal having a longest pulse width to generate decoded $2^n$ PWM signals; and displaying the gradation on the display screen based on the decoded $2^n$ PWM signals, wherein n is an integer greater than or equal to 2.

2. The display driving method as recited in claim 1, wherein in the case of a 256-color display, the encoding of the $2^n$ PWM signals generates 3 signals, based on 8 PWM signals (PW0, PW1, PW2, PW3, PW4, PW5, PW6 and PW7, whose pulse widths become longer from PW0 to PW7 in this order), the 3 signals being given by a Boolean algebra expression below $$E0=\overline{PW0}\cdot PW1+\overline{PW2}\cdot PW3+\overline{PW4}\cdot PW5+\overline{PW6}\cdot PW7$$

$$E1=\overline{PW1}\cdot PW3+\overline{PW5}\cdot PW7$$

$$E2=\overline{PW3}\cdot PW7.$$

3. The display driving method as recited in claim 2, wherein the decoding of the n encoded PWM signals based on one PWM signal having a longest pulse width includes:

generating an intermediate signal by using a Boolean algebra expression below; and $$D0=PW7\cdot\overline{E2}\cdot\overline{E1}\cdot\overline{E0}$$

$$D1=PW7\cdot\overline{E2}\cdot\overline{E1}\cdot E0$$

$$D2=PW7\cdot\overline{E2}\cdot E1\cdot\overline{E0}$$

$$D3=PW7\cdot\overline{E2}\cdot E1\cdot E0$$

$$D4=PW7\cdot E2\cdot\overline{E1}\cdot\overline{E0}$$

$$D5=PW7\cdot E2\cdot\overline{E1}\cdot E0$$

$$D6=PW7\cdot E2\cdot E1\cdot\overline{E0}$$

$$D7=PW7$$

decoding the intermediate signal into a final PWM signal by using a Boolean algebra expression below $$PW0=D0$$

$$PW1=PW0+D1$$

$$PW2=PW1+D2$$

$$PW3=PW2+D3$$

$$PW4=PW3+D4$$

$$PW5=PW4+D5$$

$$PW6=PW5+D6$$

$$PW7=D7.$$

4. The display driving method as recited in claim 1, wherein the display is a liquid crystal display (LCD).

5. A display driver circuit for displaying a gradation on a display screen based on $2^n$ PWM signals, the display driver circuit comprising:

a PWM signal generator for generating the $2^n$ PWM signals;

a PWM encoder for encoding the $2^n$ PWM signals generated from the PWM signal generator to generate n encoded PWM signals;

(n+1) signal lines for transferring (n+1) signals including the n encoded PWM signals and one PWM signal having a longest pulse width;

a PWM decoder for receiving the (n+1) signals and decoding the n encoded PWM signals based on one PWM signal having a longest pulse width to generate decoded the $2^n$ PWM signals;

a switching unit for selectively outputting the decoded $2^n$ PWM signals generated from the PWM decoder;

a data storage unit for storing a display data used to switch the switching unit; and an SRAM decoder for outputting an on/off signal to the switching unit according to the display data outputted from the data storage unit, wherein n is an integer greater than or equal to 2.

6. The display driver circuit as recited in claim 5, wherein in the case of a 256-color display, the PWM encoder generates 3 signals, based on 8 PWM signals (PW0, PW1, PW2, PW3, PW4, PW5, PW6 and PW7, whose pulse widths become longer from PW0 to PW7 in this order), the 3 signals being given by a Boolean algebra expression below $$E0=\overline{PW0}\cdot PW1+\overline{PW2}\cdot PW3+\overline{PW4}\cdot PW5+\overline{PW6}\cdot PW7$$

$$E1=\overline{PW1}\cdot PW3+\overline{PW5}\cdot PW7$$

$$E2=\overline{PW3}\cdot PW7.$$

7. The display driver circuit as recited in claim 6, wherein the PWM decoder generates an intermediate signal by using a Boolean algebra expression below $$D0=PW7\cdot\overline{E2}\cdot\overline{E1}\cdot\overline{E0}$$

$$D1=PW7\cdot\overline{E2}\cdot\overline{E1}\cdot E0$$

$$D2=PW7\cdot\overline{E2}\cdot E1\cdot\overline{E0}$$

$$D3=PW7\cdot\overline{E2}\cdot E1\cdot E0$$

$$D4=PW7\cdot E2\cdot\overline{E1}\cdot\overline{E0}$$

$$D5=PW7\cdot E2\cdot\overline{E1}\cdot E0$$

$$D6=PW7\cdot E2\cdot E1\cdot\overline{E0}$$

$$D7=PW7$$

and decodes the intermediate signal into a final PWM signal by using a Boolean algebra expression below $$PW0=D0$$

$$PW1=PW0+D1$$

$$PW2=PW1+D2$$

$$PW3=PW2+D3$$

$$PW4=PW3+D4$$

$$PW5=PW4+D5$$

$$PW6=PW5+D6$$

$$PW7=D7.$$

8. The display driver circuit as recited in claim 5, wherein the PWM signal generator and the PWM encoder are integrated into one block.

9. The display driver circuit as recited in claim 8, wherein the display is a liquid crystal display (LCD).

10. The display driver circuit as recited in claim 5, wherein the PWM decoder and the SRAM decoder are integrated into one decoder.

11. The display driver circuit as recited in claim 10, wherein the display is a liquid crystal display (LCD).

12. The display driver circuit as recited in claim 5, wherein the display is a liquid crystal display (LCD).

* * * * *

UNITED STATES PATENT AND TRADEMARK OFFICE

CERTIFICATE OF CORRECTION

PATENT NO. : 7,570,276 B2
APPLICATION NO. : 11/071605
DATED : August 4, 2009
INVENTOR(S) : Lee It is certified that error appears in the above-identified patent and that said Letters Patent is hereby corrected as shown below:

On the Title Page, Item (54), in the Title, delete "DRIVE" and insert -- DRIVING --

Signed and Sealed this

Sixth Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,570,276 B2
APPLICATION NO. : 11/071605
DATED : August 4, 2009
INVENTOR(S) : Lee It is certified that error appears in the above-identified patent and that said Letters Patent is hereby corrected as shown below:

On the Title Page, Item (54) and at Column 1, line 1, in the Title, delete "DRIVE" and insert -- DRIVING --

This certificate supersedes the Certificate of Correction issued July 6, 2010.

Signed and Sealed this

Third Day of August, 2010

David J. Kappos

David J. Kappos
*Director of the United States Patent and Trademark Office*